United States Patent [19]

Wakamiya

[11] Patent Number: 4,569,023

[45] Date of Patent: Feb. 4, 1986

[54] APPARATUS FOR CONTROLLING THE TEMPERATURE OF RODS IN A CONTINUOUS ROLLING MILL

[75] Inventor: Yoshinori Wakamiya, Hyogo, Japan

[73] Assignee: Mitsubishi Denki Kabushiki Kaisha, Tokyo, Japan

[21] Appl. No.: 458,802

[22] Filed: Jan. 18, 1983

[30] Foreign Application Priority Data

Jan. 19, 1982 [JP] Japan ..... 57-6926

[51] Int. Cl.[4] ..... G06F 15/46; B21B 37/10

[52] U.S. Cl. ..... 364/472; 72/13; 72/201

[58] Field of Search ..... 364/468, 469, 472; 72/8–14, 201, 236

[56] References Cited

U.S. PATENT DOCUMENTS 3,418,834 12/1968 Cook ..... 72/13 X
3,514,984 6/1970 Cook ..... 72/13 X
3,604,234 9/1971 Hinrichsen et al. ..... 72/13
3,764,789 10/1973 Nara ..... 364/472 X
3,905,216 9/1975 Hinrichsen ..... 72/13
4,274,273 6/1981 Fapiano et al. ..... 72/13

FOREIGN PATENT DOCUMENTS 5325257 3/1978 Japan .

*Primary Examiner*—Joseph Ruggiero
*Attorney, Agent, or Firm*—Sughrue, Mion, Zinn, Macpeak and Seas

[57] ABSTRACT

An apparatus for controlling the temperature of a material being rolled into a rod in a rod rolling line having a continuous rolling mill with a first thermometer located at an inlet thereof, a plurality of water cooling units located at an outlet thereof and having an adjustable cooling water flow rate, and a laying head for winding the rod, the laying head having a second thermometer located at an outlet thereof. The apparatus comprises an arithmetic device for computing the rate of flow of cooling water based on a rolling schedule for the continuous rolling mill, an expected temperature at an inlet of the continuous rolling mill, and a target temperature at the laying head, and a control device responsive to a result of computation by the arithmetic device for controlling the rate of flow of cooling water.

3 Claims, 2 Drawing Figures

APPARATUS FOR CONTROLLING THE TEMPERATURE OF RODS IN A CONTINUOUS ROLLING MILL

BACKGROUND OF THE INVENTION

The present invention relates to an apparatus for controlling the temperature of a rod at a laying head of a rod rolling line so as to be in conformity with a target value.

Rod rolling lines have a plurality of water cooling units disposed behind a continuous rolling mill for rapidly cooling the rods as they emerge from the rolling mill, and then gradually cooling the rods to meet the requirements for the desired quality of the rod. It is important from the standpoint of rod quality that the temperature at which the rod begins to be gradually cooled after being rapidly cooled be brought into conformity with a target value in the longitudinal direction of the rod.

It has been customary practice for the operator to control the temperature at which the rod is to begin gradual cooling by determining the rate of the flow of water through the water cooling units while referring to a rolling schedule, and correcting the rate of the flow of cooling water based on his or her individual judgment, formed on the basis of the difference between the reading on a thermometer located on the laying head where the rod is to begin cooling, and target temperatures. The prior process has sometimes failed to select the rate of flow of the cooling water properly according to the rolling schedule, and has completely failed to control skid marks or temperature changes in the rod material.

SUMMARY OF THE INVENTION

Accordingly, it is an object of the present invention to provide an apparatus for controlling the temperature of a material being rolled at a laying head so as to comform to a target temperature in the longitudinal direction of the material, by determining the flow rate of cooling water through water cooling units according to a rolling schedule for the material, and correcting the rate of water flow dependent on the difference between the temperature at an inlet of a continuous rolling mill and an expected temperature and the difference between the reading on a laying head thermometer and a target temperature.

According to the present invention, there is provided an apparatus for controlling the temperature of a material being rolled into a rod in a rod rolling line having a continuous rolling mill with a first thermometer located at an inlet thereof, a plurality of water cooling units located behind the rolling mill and having an adjustable rate of flow of cooling water flow rate, and a laying head for winding the rod, the laying head having a second thermometer located at an outlet thereof, the apparatus comprising an arithmetic device for computing the flow rate of cooling water based on a rolling schedule for the continuous rolling mill, an expected temperature at an inlet of the continuous rolling mill, and a target temperature at the laying head, and a control device responsive to a result of computation by the arithmetic device for controlling the rate of flow of the cooling water.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENTS

Figure 1:
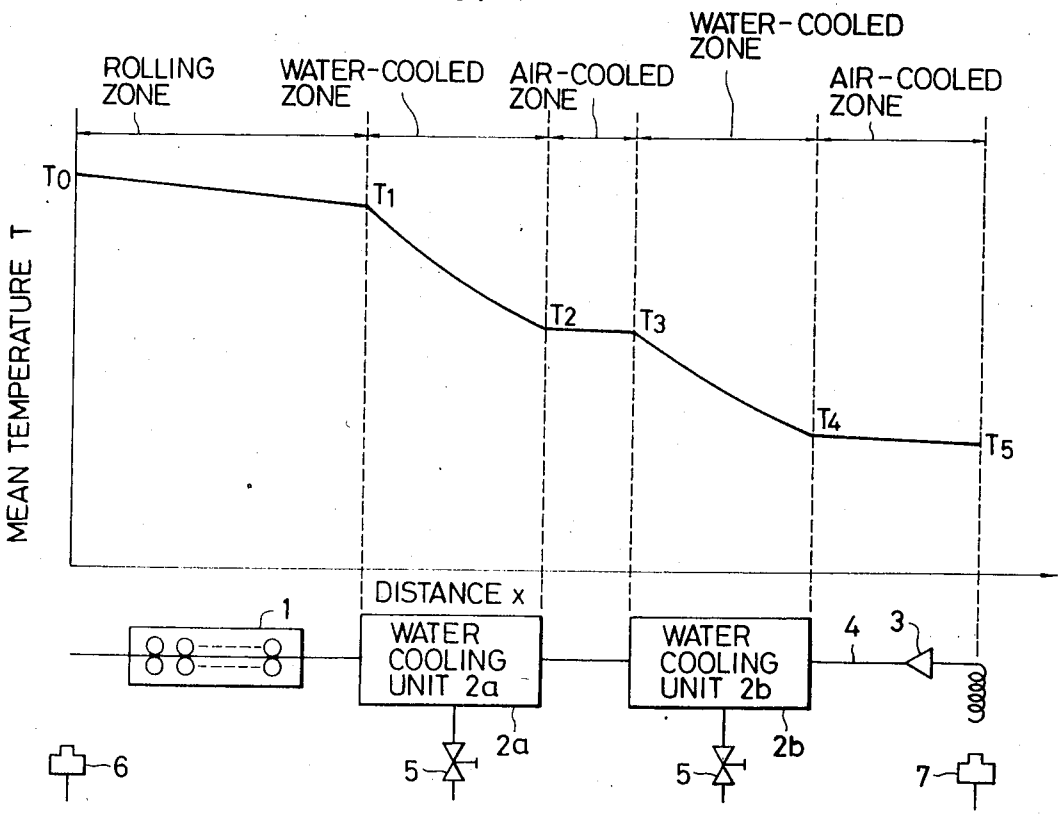
FIG. 1 is a diagram showing rolling line components related to temperature control and mean temperatures of a material being rolled, respectively, at positions corresponding to the rolling line components.

As shown in FIG. 1, a continuous rolling line includes a continuous rolling mill 1, first and second water cooling units 2*a*, 2*b*, a laying head 3 for winding a rod 4 as it is produced, flow control valves 5 associated with the water cooling units 2*a*, 2*b*, respectively, a thermometer 6 at an inlet of the continuous rolling line, and a thermometer 7 at the laying head 3.

Mean temperatures $T_0$ through $T_5$ of the material being rolled are measured at the following positions on the continuous rolling line:

$T_0$ . . . the inlet thermometer 6;

$T_1$ . . . the inlet of the first water cooling unit 2*a*;

$T_2$ . . . the outlet of the first water cooling unit 2*a*;

$T_3$ . . . the inlet of the second water cooling unit 2*b*;

$T_4$ . . . the outlet of the second water cooling unit 2*b*; and $T_5$ . . . the laying head thermometer 7.

Figure 2:
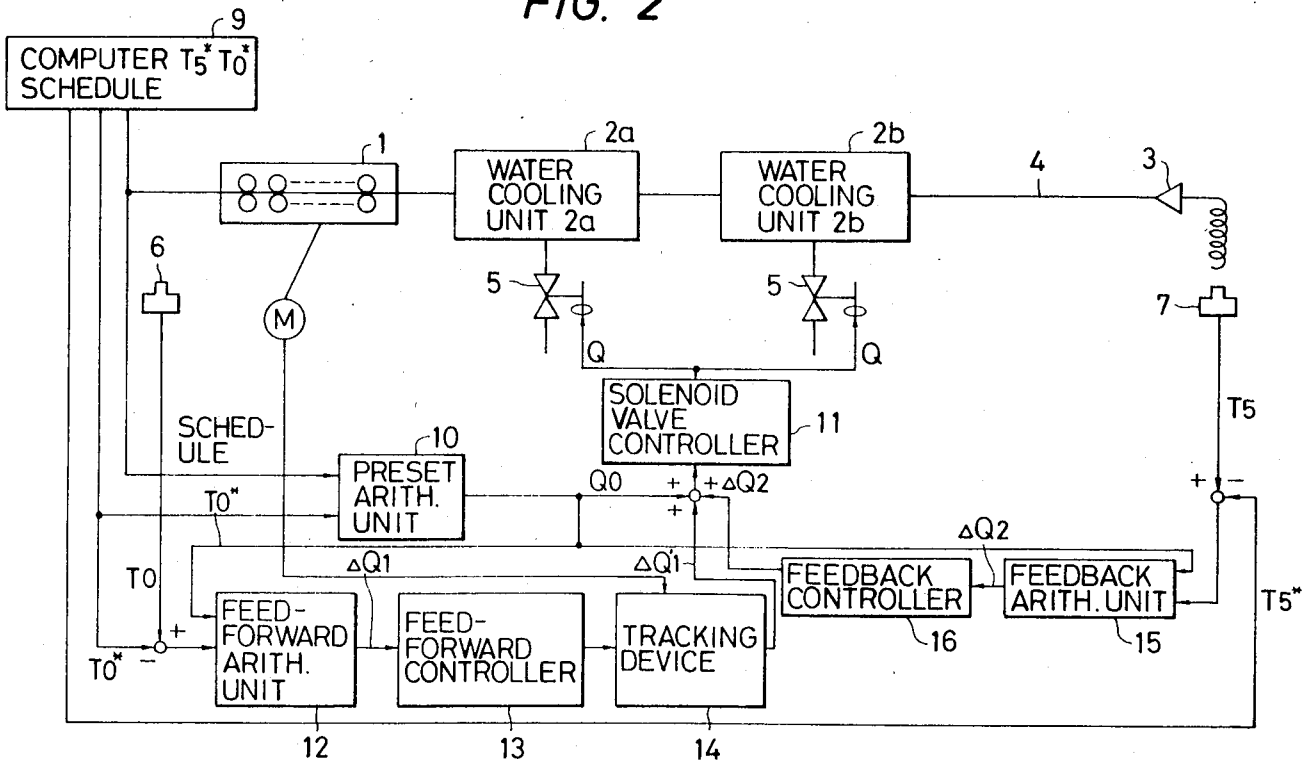
FIG. 2 is a block diagram of an apparatus for controlling the temperature of a material being rolled into a rod according to the present invention.

In FIG. 2, the apparatus for controlling the temperature of the material being rolled comprises a computer 9 for generating an expected inlet temperature $T_0$*, a target temperature $T_5$* at the laying head 3 and a rolling schedule, an arithmetic unit (hereinafter referred to as a "preset arithmetic unit") 10 for computing an initialized rate of flow of cooling water, a controller 11 for controlling solenoid-operated valves based on a flow setting, an arithmetic unit (hereinafter referred to as a "feed-forward arithmetic unit") 12 for computing a corrected rate of flow dependent on a deviation in the reading on the inlet thermometer 6, a feed-forward controller 13, a tracking device 14 for tracking the material being rolled from the inlet thermometer 6 to the water cooling units to compute a time delay, an arithmetic unit (hereinafter referred to as a "feedback arithmetic unit") 15 for computing a corrected rate of flow based on a deviation in the reading on the laying head thermometer 7, and a feedback controller 16.

The operation of the control apparatus is as follows: An initial flow rate setting for the water cooling units is determined in the following manner. The computer 9 supplies the preset arithmetic unit 10 with an expected inlet temperature $T_0$*, a target temperature $T_5$* at the laying head 3 and a rolling schedule. The rolling schedule comprises:

(i) the diameter $D_0$ of the material at the inlet of continuous rolling stands;

(ii) the diameter di of the material at the outlet of the continuous rolling stands; and (iii) the speed V of movement of the material at the outlet of the continuous rolling stands.

The preset arithmetic unit 10 computes a flow setting $Q_0$ in the following order:

(1) The temperature $T_1$ at the inlet of the first water cooling unit 2a is computed from the expected inlet temperature $T_0$* based on the equation:

$$T_1 = T_0^* - (\Delta Tp + \Delta Tf - \Delta Tc) \quad (1)$$

where

ΔTp: the temperature increase due to rolling operation in the continuous rolling mill;

ΔTf: temperature increase due to frictional heating in the continuous rolling mill; and ΔTc: temperature drop due to contact with the continuous rolling mill.

These temperature changes ΔTp, ΔTf, and ΔTc are computed by the equations:

$$\Delta Tp = \frac{km \cdot lu\,(D0/dn)}{cp \cdot \gamma} J_1 \quad (2)$$

where dn is the diameter at the outlet of the continuous rolling stands, cp the specific heat, γ the specific weight, $J_1$ the coefficient of conversion from work into heat energy, and km the resistance to restrained deformation, which is a function of the temperature $T_0$*.

$$\Delta Tf = \frac{(4p/\pi dn^2 V) \cdot J2 - km\ hn\,(D0/dn) \cdot J1}{cp \cdot \gamma} \cdot \beta \quad (3)$$

where p is the roller power of all of the rolling stands, J2 the coefficient of conversion from power into heat energy, and β the ratio at which the heat energy is distributed to the rolled material and the rolls.

$$\Delta Tc = \beta(T_0^* - Tr)\sqrt{\frac{k \cdot \Delta tr}{\pi}}\ \frac{8}{\overline{Dr}} \quad (4)$$

where Tr is the temperature of the rolls, k the temperature conductivity (=(λ/cp·γ), the thermal conductivity, Δtr the time required for the rolled material to move from the inlet thermometer 6 to the first water cooling unit 2a, and $\overline{Dr}$ the mean diameter $$\left(\overline{Dr} = \frac{1}{n}\sum_{L=1}^{n} di\right)$$

of the rod in the continuous rolling mill.

(2) Then, the temperature $T_4$ at the outlet of the second water cooling unit 2a is computed using the laying head target temperature $T_5$* by the following equation:

$$T_4 = T_5^* + \frac{4\sigma\epsilon\Delta t_{45}}{cp\gamma dn}\left(\frac{T_5^* + 273}{100}\right)^4 \quad (5)$$

where σ is the Stefan-Boltzmann constant, ε the coefficient of radiation of the rod material, and $\Delta t_{45}$ the time required for the material to travel from the outlet of the second water cooling unit 2b to the laying head thermometer 7.

(3) Thereafter, a temperature drop $\Delta T_{23}$ due to air cooling at a point between the first and second water cooling units 2a, 2b is found. Where the point is equidistant from the first and second water cooling units 2a, 2b, the temperature $T_2$ at the outlet of the first water cooling unit 2a can be expressed by:

$$T_2 = T_1 - \frac{(T1 - T4)}{1 + \sqrt{\frac{T4 - Tw}{T1 - Tw}}} \quad (6)$$

where Tw is the water temperature. The temperature drop $\Delta T_{23}$ can be expressed using $T_2$ as follows:

$$\Delta T_{23} = \frac{4\sigma\epsilon\Delta t_{23}}{cp\gamma dn}\left(\frac{T2 + 273}{100}\right)^4 \quad (7)$$

(4) From the foregoing, a total temperature drop ΔTwater at the first and second water cooling units is given by:

$$\Delta T\text{water} = (T_1 - T_4) - \Delta T_{23} \quad (8)$$

(5) The mean thermal conductivity h required for cooling the material by the temperature drop ΔTwater in the two water cooling units can be derived using the temperature $T_1$ at the inlet of the first water cooling unit 2a as follows:

$$\bar{h} = \frac{cp \cdot \gamma \cdot dn}{2\Delta tw} \cdot l_u\left(\frac{T1 - Tw}{(T_1 - \Delta T\text{water} - Tw)}\right) \quad (9)$$

(6) It is known that the mean thermal conductivity h of the water cooling units and the flow rate Q have the following relationship:

$$h = AQ^B \quad (10)$$

where A, B are constants.

Hence, the flow rate setting $Q_0$ can be given by the following equation which is a modification of the equation (10):

$$Q_0 = \left(\frac{h}{A}\right)^{1/B} \quad (11)$$

With the flow rate setting $Q_0$ thus determined, the preset arithmetic unit 10 delivers this setting to the solenoid-valve controller 11.

Flow rate correction through feed-forward control will be described for an instance in which the inlet temperature is different from the expected temperature $T_0$* under the influence of a skid mark, thermal rundown, or the like. The feed-forward arithmetic unit 12 computes the difference between the actual temperature $T_0$ at the inlet thermometer 6 and its expected temperature according to the following equation:

$$\Delta T_1 = \left\{\frac{C}{T_0^{*2}}(\Delta Tp + \Delta Tf) - \frac{\Delta Tc}{T_0^*}\right\} \cdot \Delta T_0 \quad (12)$$

where ΔTp, ΔTf, ΔTc are temperatures computed by the preset arithmetic unit, and C a constant.

Then, a corrected value Δh for the mean thermal conductivity required to bring the temperature of the laying head into conformity with the target temperature is determined by the following equation, using the difference $\Delta T_1$ as determined by equation (12):

$$\Delta h = \frac{cp \cdot \gamma \cdot dn}{2\Delta t} \quad \frac{\Delta T_1}{(T_1 - Tw)} \tag{13}$$

A corrected rate of flow $\Delta Q_1$ for $Q_0$ is determined by the following equation, using $\Delta h$:

$$Q_1 = \frac{Q_0}{B \cdot h} \cdot \Delta h \tag{14}$$

The feed-forward arithmetic unit 12 delivers as an output the corrected rate of flow $\Delta Q_1$ to the feed-forward controller 13, which effects usual P control based on the corrected rate of flow $\Delta Q_1$ and issues an output value $\Delta Q_1'$ to the tracking device 14. The tracking device 14 tracks the material from the inlet thermometer 6 to the water cooling units based on the number of RPM of the motor in the continuous rolling mill to compute a time delay, and adds the value $\Delta Q_1'$ to the flow rate setting $Q_0$ based on the computed timing and delivers the sum to the solenoid-operated valve controller 11.

As described above, setting and correction effected by the preset arithmetic unit 10 and the feed-forward arithmetic unit 12 is of the open-type control. To compensate for this, feedback control is carried out on the basis of the difference between the reading on the laying head thermometer 7 and the target temperature $T_5$* as follows:

The feedback arithmetic unit 15 derives a deviation $\Delta T_4$ of temperature at the outlet of the second water cooling unit 2b from the difference $\Delta T_5$ ($=T_5-T_5$*) between the actual reading $T_5$ on the laying head thermometer 7 and the target temperature $T_5$*.

$$\Delta T_4 = \frac{\Delta T_5}{\left\{1 - \frac{4}{100} \quad \frac{6\epsilon\sigma\Delta t_{45}}{cp \cdot \gamma \cdot H}\left(\frac{T4 + 273}{100}\right)^3\right\}} \tag{15}$$

where $T_4$ is the temperature as computed by the preset arithmetic unit 10. Using the temperature deviation $\Delta T_4$, a corrected value $\Delta h_2$ for the mean thermal conductivity is determined by the following equation:

$$h_2 = -\frac{cp \cdot \gamma \cdot dn}{2\Delta t\text{water}} \quad \frac{\Delta T_4}{(T_4 - Tw)} \tag{16}$$

A corrected rate of flow $\Delta Q_2$ is determined by the following equation, using the above corrected value $\Delta h_2$:

$$\Delta Q_2 = \frac{Q}{h \cdot B} \cdot \Delta h_2 \tag{17}$$

The feedback arithmetic unit 15 delivers the corrected rate of flow $\Delta Q_2$ as an output to the feedback controller 16, which effects usual PI control based on the corrected rate of flow $\Delta Q_2$, and then adds an output $\Delta Q_2'$ to the setting $Q_0$ and issues the sum to the solenoid-operated valve controller 11.

While in the foregoing embodiment only two water cooling units have been described and shown, any desired number of water cooling units can be controlled by similar controlling arrangements of the present invention. In the illustrated embodiment, the expected inlet temperature $T_0$*, the target temperature $T_5$*, and the rolling schedule are delivered from the computer, these data items may as well be set up by the operator.

With the arrangement of the present invention, an initial setting for the rate of flow of cooling water for the water cooling units is made according to a rolling schedule without requiring the operator's manual operation, and the rate of flow is controllably corrected on the basis of the difference between a reading on the inlet thermometer and an expected temperature therefor and the difference between a reading on the laying head thermometer and a target temperature therefor. Accordingly, the temperature at the laying head can be kept very nearly constant.

Although a certain preferred embodiment has been shown and described, it should be understood that many changes and modifications may be made therein without departing from the scope of the appended claims.

What is claimed is:

1. An apparatus for controlling the temperature of a material being rolled into a rod in a rod rolling line having a continuous rolling mill with a first thermometer located at an inlet thereof, a plurality of water cooling units located behind said rolling mill and having an adjustable rate of flow of cooling water, and a laying head for winding the rod, the laying head having a second thermometer located at an outlet thereof, said apparatus comprising an arithmetic device for computing the rate of flow of cooling water based on a rolling schedule for the continuous rolling mill, an expected temperature at an inlet of the continuous rolling mill, and a target temperature at the laying head, and a control device responsive to a result of computation by said arithmetic device for controlling the rate of flow of cooling water.

2. An apparatus according to claim 1, wherein said arithmetic device includes means for computing a corrected value for the rate of flow based on the difference between an actual reading on the first thermometer and an expected temperature at the inlet of the continuous rolling mill and a flow rate setting from the time when the material turns on the first thermometer, and wherein said control device includes means for correcting the rate of flow based on a result of computation by said first-mentioned means and for tracking the material from the first thermometer to the water cooling units to compute corrective timing.

3. An apparatus according to claim 1, wherein said arithmetic device includes means for correcting the rate of flow based on the difference between an actual reading on the second thermometer and a target temperature therefor and a flow rate setting from the time when the rod turns on the second thermometer, and wherein said control devices includes means for correcting the rate of flow based on a result of computation of said first-mentioned means.

* * * * *